United States Patent [19]

Bell

[11] 4,306,947

[45] Dec. 22, 1981

[54] ELECTROCHEMICAL CATALYTIC CARBONATE PROCESS

[75] Inventor: Robert A. Bell, Schenectady, N.Y.

[73] Assignee: General Electric Company, Schenectady, N.Y.

[21] Appl. No.: 156,336

[22] Filed: Jun. 4, 1980

[51] Int. Cl.[3] ..... C25B 3/02

[52] U.S. Cl. ..... 204/59 R; 204/78

[58] Field of Search ..... 204/59 R, 78

[56] References Cited

U.S. PATENT DOCUMENTS

| | | | |
|---|---|---|---|
| 3,114,762 | 12/1963 | Mador et al. | 260/463 |
| 3,397,226 | 8/1968 | Fenton | 204/59 R |
| 4,131,521 | 12/1978 | Cipris et al. | 204/59 R |

*Primary Examiner*—F. Edmundson

*Attorney, Agent, or Firm*—Joseph T. Cohen; James C. Davis, Jr.

[57] ABSTRACT

An electrochemical catalytic β-fluoroaliphatic carbonate process comprising contacting β-fluoroalcohol, carbon monoxide, a Group VIIIB catalyst, an electrolyte containing a chloride, bromide or iodide ion, and a direct electric current.

9 Claims, 1 Drawing Figure

ELECTROCHEMICAL CATALYTIC CARBONATE PROCESS

CROSS-REFERENCE TO RELATED APPLICATIONS

Figure 1:
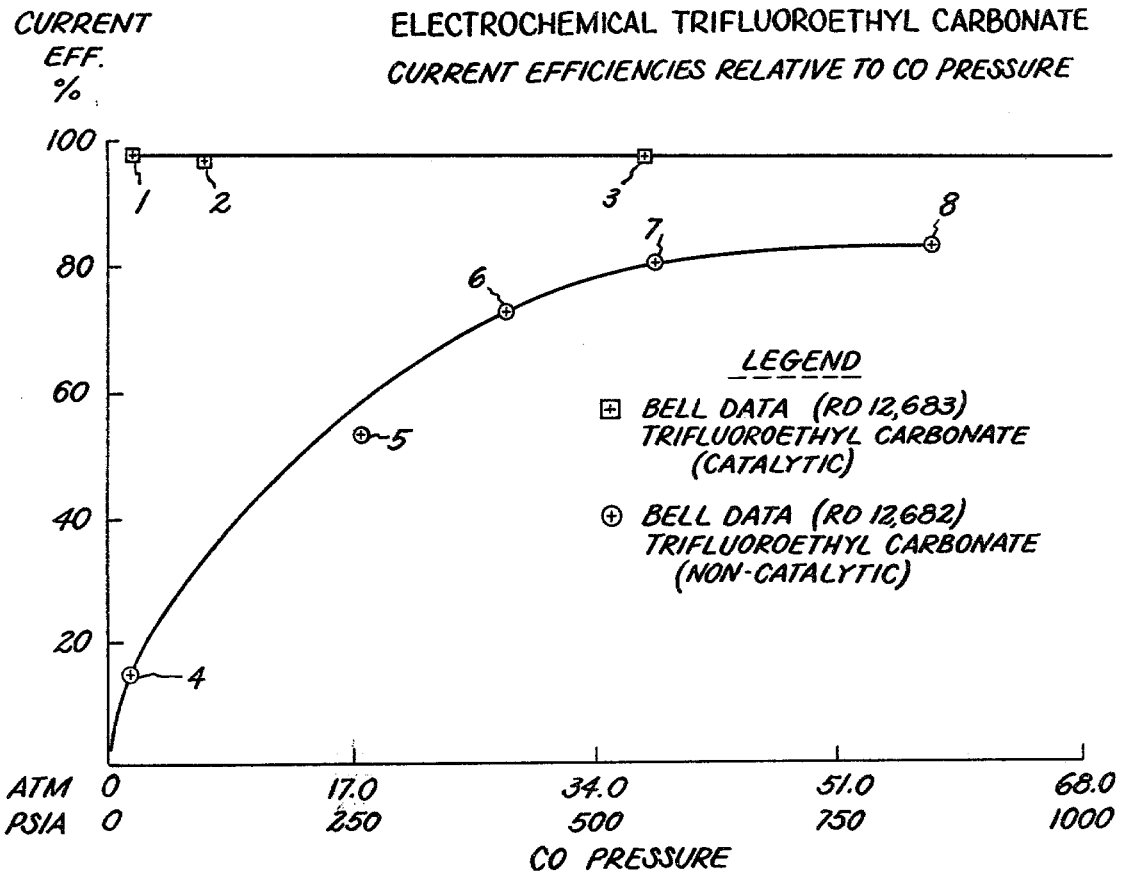

This invention is related to my copending U.S. patent applications Ser. Nos. 154,150 and 157,478 filed May 29, 1980 and June 9, 1980, respectively. All of the aforesaid applications are assigned to the same assignee as the assignee of this invention.

BACKGROUND OF THE INVENTION

1. Field of the Invention

This invention relates to an electrochemical catalytic β-fluoroaliphatic carbonate process comprising contacting a β-fluoroalcohol, carbon monoxide, a Group VIIIB catalyst, an electrolyte containing a chloride, bromide or iodide ion and a direct electric current. The β-fluoroaliphatic carbonates resulting from the process can be employed in situ or isolated from the reaction mixture in the preparation of mono- or polycarbonates.

2. Description of the Prior Art

Fenton in U.S. Pat. No. 3,397,226, issued Aug. 13, 1968, describes the preparation of esters of unsaturated carboxylic acids, esters of dicarboxylic acids and esters of beta-alkoxy-substituted carboxylic acids. Fenton's products are formed by contacting alcohols, olefins, carbon monoxide "a platimum or palladium sub-group metal," i.e. platinum, rhodium, ruthenium, palladium, iridium or osmium, and a "redox agent," i.e. a multivalent metal salt having an oxidation potential higher (more positive) than the platinum metal in solution. Fenton also describes reoxidation of the redox agent by electrolysis.

Cipris and Mador in U.S. Pat. No. 4,131,521, issued Dec. 26, 1978, describes an electrochemical process for synthesizing organic carbonates by electrolyzing a liquid medium consisting essentially of a nonfluoride halide-containing electrolyte and a paraffinic monohydric or 1,2-dihydric alcohol under a carbon monoxide atmosphere.

DESCRIPTION OF THE INVENTION

This invention embodies an electrochemical catalytic β-fluoroaliphatic carbonate process comprising contacting a β-fluoroalcohol, carbon monoxide, a Group VIIIB catalyst an electrolyte containing a chloride, bromide or iodide ion, and a direct electric current.

The following intermediate reactions—believed to be operable during the course of this process—are furnished for illustrative purposes. This process, however, is not to be construed as being limited to the contemplated intermediate reactions, since the reaction mechanisms involved in the preparation of carbonates may be much more complex.

Equation I (intermediate)

(a) $2Br^- \xrightarrow{-2e} Br_2$ (b) $Br_2 + RO^-/ROH \longrightarrow ROBr + Br^- + H^+$ (c) $ROBr + M \longrightarrow RO{-}M{-}Br$ (d) $RO{-}M{-}Br + CO \longrightarrow ROC(=O){-}M{-}Br$ (e) $ROC(=O){-}M{-}Br + RO^-/ROH \longrightarrow$ -continued $R_2CO_3 + M + Br^-$ (f) $2ROH \xrightarrow{+2e} 2RO^- + H_2$ Equation II (net result)

$ROH + CO \longrightarrow R_2CO_3 + H_2$ wherein R is a β-fluoroalkyl (including β-fluorocycloalkyl) radical, and M is a Group VIIIB element.

Any "β-fluoroalcohol" can be used in this process. Illustratively, the β-fluoroalcohol reactant can be described by the generic formula:

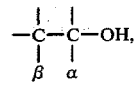

(I)

which describes the essential features of a β-fluoroalcohol reactant, i.e. alcohols of the class wherein at least one hydroxyl group is separated from a fluorinated aliphatic or cycloaliphatic carbon atom by at least two aliphatic carbon atoms. The fluorine atoms, as illustrated by the specific examples set out hereafter, can be associated with any β carbon atom as well as other γ, δ, ε, etc. carbon atoms—subject to the above class requirement. Further, the β-fluoroalcohols can be mono- or polyhydroxy-functional, as well as saturated, unsaturated, linear, branched, monocyclic, polycyclic or fused polycyclic. The cyclic systems may be connected to each other by single valence bonds or multivalent radicals. Presently preferred are β-fluoroaliphatic alcohols, including β-fluorocycloaliphatic alcohol, reactants which contain from 2–20, and more preferably from 2–10 carbon atoms. Still more preferred are β-fluoroacyclicaliphatic alcohols which contain from 2–4 carbon atoms. Illustrative of commercially important β-fluoroalcohols include the following:

$CH_2FCH_2OH$,
$CHF_2CH_2OH$,
$CF_3CH_2OH$,
$(CF_3)_2CHOH$,
$CF_3CF_2CH_2OH$,
$CF_3CH(CH_3){-}OH$,
$H_3C{-}CF_2{-}CH(CH_3){-}OH$
$CF_3CF_2CF_2CH_2OH$,
$(CF_3)_3COH$,

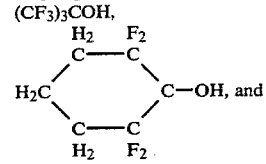

, and $C_{18}H_{37}{-}CF_2{-}CH_2{-}OH$, etc.

Any Group VIIIB catalyst can be employed, e.g. iron, cobalt, nickel, ruthenium, rhodium, palladium, osmium, iridium or platinum. The catalysts can be introduced into the electrochemical reaction media in any form and in any of their well-known oxidation states, however, preferably are introduced in their zero valent elemental, i.e. metallic form. Of the Group VIIIB elements palladium is the preferred catalyst species. In general, the efficacy of the catalysts—relative to the members of Group VIIIB is as follows:

Pd>Pt, Rh, Ir>Fe, Ru, Os>Co>Ni

In addition to their well-known metallic forms, the catalysts can also be employed in well-known Group VIIIB inorganic or organic compound or complex etc. forms. Accordingly, illustratively, the Group VIIIB catalysts can be employed in oxide, halide, nitrate, sulfate, oxalate, acetate, carbonate, propionate, hydroxide, tartrate, etc. forms.

Additionally, illustratively, the Group VIIIB catalysts can be employed in complex form, e.g. with ligands, such as carbon monoxide, nitriles, tertiary amines, phosphines, arsines, or stibines, etc. These complex forms are often represented as mono-, di-, or polynuclear Group VIIIB element forms. Generally the dimeric or polymeric forms are considered to contain Group VIIIB atoms bridged by ligands, halogens, etc.

Illustratively presently preferred Group VIIIB catalyst compounds or complexes follow: $RuCl_2$, $RuBr_2$, $RuI_2$, $Ru(CO)_2Cl_2$, $Ru(CO)_2I_2$, $Ru(CO)_4Cl_2$, $Ru(CO)_4Br_2$, $Ru(CO)_4I_2$, $RuCl_3$, $RuBr_3$, $RuI_3$, etc., $PdCl_2$, $PdBr_2$, $PdI_2$, $[Pd(CO)Cl_2]_2$, $[Pd(CO)Br_2]_2$, $[Pd(CO)I_2]_2$, $PdCl_4$, etc., $Ru(CO)Cl_2$, $Rh(CO)Br_2$, $Rh(CO)I_2$, $Rh_2Cl_2(CO)_2$, $Rh_2(CO)_4Cl_2$, $Rh_2(CO)_4Br_2$, $Rh_2(CO)_4I_2$, $[Rh(CO)_2Cl]_2$, $RhCl_3$, $RhBr_3$, $RhI_3$, etc., $Os(CO)_3Cl_2$, $Os(CO)_3Br_2$, $Os(CO)_3I_2$, $Os(CO)_4Cl_2$, $Os(CO)_4Br_2$, $Os(CO)_4I_2$, $Os(CO)_8Cl_2$, $Os(CO)_8Br_2$, $Os(CO)_8I_2$, $OsCl_2$, $OsCl_3$, $OsI_2$, $OsI_3$, $OsBr_3$, $OsBr_4$ and $OsCl_4$, etc., $IrCl_3$, $IrCl_3(CO)$, $Ir_2(Co)_8$, $IrCl_3$, $IrBr_3$, $IrCl_3$, $IrBr_4$, $IrI_4$, etc. $PtCl_2$, $PtBr_2$, $PtI_2$, $Pt(CO)_2Cl_2$, $Pt(CO)_2Br_2$, $Pt(CO)_2I_2$, $Pt(CO)_2Cl_4$, $Pt(CO)_2Br_4$, $Pt(CO)_2I_4$, $Pt(CO)_3Cl_4$, $Pt(CO)_3Br_4$, $Pt(CO)_3I_4$, etc.

Any electrolyte can be employed, e.g. any substance which is soluble in the β-fluoroalcohol phase which enhances the transfer, maintenance or retention of a chloride, bromide or iodide ion in the β-fluoroalcohol phase during passage of a direct current through the electrolyte during the formation of β-fluoroaliphatic carbonates. Preferred electrolytes consist of inorganic or organic compounds or complexes which contain chlorine, bromine or iodine atoms, and which in the presence of a direct electric current dissociate in the β-fluoroalcohol phase to provide a source of chloride, bromide, or iodide ions.

Presently preferred electrolytes are selected from alkali metal (Group IA), alkaline earth metal (Group IIA) or quaternary ammonium, quaternary phosphonium or tertiary sulphonium chlorides, bromides, or iodides, including mixtures thereof. Illustrative electrolytes are lithium chloride, lithium bromide lithium iodide, sodium chloride, sodium bromide, potassium chloride, potassium bromide, potassium iodide, ammonium chloride, ammonium bromide, ammonium iodide, tetrabutylammonium bromide, trimethyloctadecylammonium bromide, etc. The halide ions preferably associated with the electrolyte in this process are ranked accordingly: bromide ion>chloride ion>iodide ion.

Any source of direct current can be employed. Current densities generally economically suited to the process are within the range of from about 1-1000 milliamps per square centimeter—based on the effective surface area in square centimeters of the electrodes employed in the process, i.e. the combined surface area of both cathode and anode electrodes—can be employed. Presently preferred process current densities are about 10-200 milliamps per square centimeter.

The electrodes that are employed can be any which are economically suited to the process, i.e. not deleteriously oxidized or reduced during the course of the electrolytic process. In general, the anodes can be selected from any conductive material which resists halogen attack including well-known commercial metal electrodes, commonly employed in the electrolytic production of chlorine from sodium chloride brine. Illustrative of generally suitable anode electrodes are graphite, metal oxide coated titanium substrates supported on a conductive metal core, such as copper, aluminum, iron or alloys of these metals. U.S. Pat. No. 3,839,181 describes oxide coated electrodes in greater detail. The cathodes like the anodes, can be made of any conductive material which is not deleteriously effected during the course of the reaction. Illustrative of generally suitable cathodes include stainless steel, graphite, lead, etc. The cathodes can be made from high, medium or low hydrogen overpotential materials, however preferably are made from electrodes which exhibit low hydrogen overpotential since one of the by-products of the process is hydrogen gas evolution at the cathode.

In addition to the above electrolytes, "supporting electrolytes" (electrolytes which are free of halides) can be used in the processes. Illustrative of preferred supporting electrolytes include lithium arsenic hexafluoride, lithium antimony hexafluoride, lithium phosphorous hexafluoride, lithium perchlorate, lithium tetrafluoroborate, lithium tetraphenylborate, methyl sulfonate, ethyl sulfonate, etc. Further, although the preferred supporting electrolytes involve a lithium cation any of the other Group IA metal, IIA metal, quaternary, or tertiary cations can be substituted for the lithium cation in association with arsenic hexafluoride, etc., anions to provide other useful supporting electrolyte options.

Generally, the β-fluoroalcohol acts as both reactant and solvent in the process, however, optionally "supplemental solvents" such aprotic solvents which are oxidatively stable and exhibit, preferably, relatively high dielectric strength can also be used. Illustratively generally useful aprotic solvents include the following: dimethylether, monoglyme, diglyme, triglyme, propylene carbonate, ethylene carbonate, tetrahydrofuran, 1,3-dioxolane, dimethylacetamide, dimethylformamide, dimethylpropionamide, N-methyl-2-pyrrolidone, nitromethane, nitrobenzene, sulfolane, dimethyl sulfoxide, 1,4-dioxane, pyridine, hexamethylphosphoramide, and 2-methyl tetrahydrofuran, etc.

The process can be carried out in the presence of any amount of the various reactants, e.g. β-fluoroalcohol, carbon monoxide, Group VIIIB catalyst, bromide, chloride or iodide containing electrolyte and any amount of reaction adjuncts, e.g. supporting electrolytes, solvents or halogens, i.e. bromine, chlorine, or iodine.

Any amount of carbon monoxide can be employed. Preferably the process is carried out with carbon monoxide present in amounts at least sufficient to provide—on a stoichiometric basis—sufficient carbon monoxide to convert all the β-fluoroalcohol reactant to β-fluoroaliphatic carbonates.

Due to the unexpected efficacy of the Group VIIIB catalysts, β-fluoroaliphatic carbonates can be formed in this process at significantly higher current efficiencies and significantly lower pressures than those associated with the non-catalytic electrochemical process described in my U.S. copending Ser. No. 157,478 as illustrated by FIG. 1.

The term "current efficiency" as used herein is expressed in percent (%) and is based on the calculation set out hereafter:

$$\text{Current Efficiency Percent} = \frac{\text{actual mols } \beta\text{-fluoroaliphatic carbonate product produced}}{\text{theoretical maximum mols of } \beta\text{-fluoroaliphatic carbonate product based on total F (faradays) passed through the electrolyte}} \times 100$$

The above calculation describes the mol ratio of β-fluoroaliphatic carbonate actually produced by the process as a percentage of the maximum theoretical amount of β-fluoroaliphatic carbonate which would be produced per Faraday of direct current passed through the electrolyte—assuming a two electron exchange is involved for each mole of β-fluoroaliphatic carbonate actually produced and also assuming all electron transfers are limited to the formation of β-fluoroaliphatic carbonate.

Although this process can be carried out at any pressure, e.g. pressures as high as 1500 lbs. per sq. inch (approximately 100 atmospheres or higher)—because of the efficacy of the Group VIIIB catalysts—this process can be carried out at any pressure—including atmospheric pressure, while obtaining significantly higher β-fluoroaliphatic carbonate current efficiencies when compared to the non-catalytic electrochemical process described in my U.S. copending Ser. No. 157,478—a process generally similar to that of this invention but different since Ser. No. 157,478 does not use Group VIIIB catalyst. The economic advantages associated with low reaction pressures and high current efficiencies will be apparent to those of ordinary skill in the art, since the application of such benefits in a commercial electrochemical β-fluoroaliphatic carbonate process significantly reduces the capital costs compared to the capital costs associated with non-catalytic electrochemical processes, e.g. the non-catalytic process described in U.S. Ser. No. 157,478.

Any amount of Group VIIIB catalyst can be employed. As used herein the term "an effective amount of catalyst" describes any amount of catalyst which increases current efficiencies in the electrochemical formation of β-fluoroaliphatic carbonates when compared to other carbonate processes, e.g. my U.S. copending Ser. No. 157,478. Illustratively Group VIIIB catalyst to β-fluoroalcohol mole proportions within the range of from about $1\times10^{-8}$:1 or lower to about $1\times10^{-2}$:1 or higher are effective; however, preferably ratios of from $1\times10^{-6}$:1 to $1\times10^{-3}$:1, and more preferably from $1\times10^{-5}$:1 to $1\times10^{-4}$:1 are employed.

Any amount of electrolyte can be employed. Illustratively, an effective amount of electrolyte can be as low as one weight percent (1%) or lower—based on the weight of β-fluoroalcohol, and optionally any supplemental solvent—to as high as ten weight percent (10%) or higher. Additionally any amount of supporting electrolyte can be employed, including amounts as low as one weight percent (1%) to as high as ten weight percent (10%)—again based on the weight of β-fluoroalcohol as well as any supplemental solvent. Those of ordinary skill in the art based on routine experimentation will be able to determine the optimum amounts of an electrolyte and supporting electrolyte useful in obtaining the high current efficiencies associated with this invention.

Any amount of supplemental solvent can be employed. Accordingly, the amount of supplemental solvent can vary from as little as one weight percent (1%) or lower to as high as ninety weight percent (90%) or higher—based on the total weight of the β-fluoroalcohol and supplemental solvent. The use of a supplemental solvent may enhance the separation of β-fluoroaliphatic carbonate product from the reactants, maintenance of the Group VIIIB catalyst in the β-fluoroalcohol reaction phase, as well as increase the solubility of electrolyte, supporting electrolyte, or any organic salts formed in the β-fluoroalcohol phase during the course of the process.

Any reaction temperature can be employed. In general, because of the catalytic nature of the reaction, the conversion of β-fluoroalcohols to β-fluoroaliphatic carbonates occurs readily at room temperature and accordingly reaction temperatures of 0° C. or lower or up to 50° C. or even higher can be employed.

Any reaction time period can be employed. Generally optimum reaction time periods are from 1 hour or even less to about 24 hours or even more.

In order that those skilled in the art may better understand this invention, the following BEST MODE examples are furnished.

BEST MODE

EXAMPLE I

A stainless steel, high pressure, electrolytic cell containing a glass liner having a maximum capacity of 200 milliliters of solution was fitted with two spectroscopic grade graphite rods. The graphite rods, individually, served as anode and cathode electrodes. The electrodes were connected to a direct current power supply using a Power Designs, Inc. Model 5015T system. The glass-lined electrolytic cell was connected to a 500 milliliter carbon monoxide gas reservoir.

The cell was charged with 4.5 grams (52 mmol) of lithium bromide electrolyte, 30 ml (0.41 mol) of 2,2,2-trifluoroethanol, 250 microliters of 1,2-dichloroethane (internal GC calibration standard), and 20 mg milligrams of a catalyst consisting of 5% by weight of palladium deposited on a carbon substrate. The carbon supported palladium catalyst is a commercial product of Englehardt Minerals and Chemicals Company.

The cell was pressurized with carbon monoxide to 45 psia and a direct current of 100 milliamps was passed through the solution at room temperature 20°-23° C. for three hours. At the end of the three-hour period, after passage of 0.011 faradays of electricity through the cell, the contents of the cell were analyzed by gas chromatography and 1.25 grams of bis(2,2,2-trifluoroethyl) carbonate (114 grams per faraday) were found. Assuming a two-electron transfer process 1.25 grams of bis(2,2,2-trifluoroethyl) carbonate corresponds to a current efficiency of about 99%. This current efficiency of 99% at 45 psia is plotted as Data point 1 in FIG. 1.

EXAMPLE II

Under similar reaction conditions identical to those described in Example I—with the exception that the reaction CO pressure was 115 psia (7.8 atmospheres)—a total of 1.22 grams of bis(2,2,2-trifluoroethyl) carbonate was formed after passage of 0.011 faradays of electricity through the cell, corresponding to a current efficiency of 96.5%. This current efficiency of 96.5% at 115 psia is plotted as Data point 2 in FIG. 1.

EXAMPLE III

Under similar reaction conditions identical to those described in Exampe I—with the exception that the reaction CO pressure was 550 psia (37.4 atmospheres), and that the current was passed through the solution for three and one-half hours—a total of 1.46 grams of bis(2,2,2-trifluoroethyl) carbonate was formed after passage of 0.013 faradays of electricity through the cell, corresponding to a current efficiency of 99%. This current efficiency of 99% at 550 psia is plotted as Data point 3 in FIG. 1.

COMPARATIVE BELL DATA—Ser. No. 157,478

A series of reactions were carried out at various pressures in the absence of a Group VIIIB catalyst in accordance with the general procedures set out in Example I.

EXAMPLE IV

Under similar reaction conditions identical to those described in Example I—with the exception that no Group VIIIB catalyst was present and that the current was passed through the solution for five and one-half hours—a total of 0.31 grams (1.37 mmols) of bis(2,2,2-trifluoroethyl) carbonate was formed after passage of 0.020 faradays of electricity through the cell, corresponding to a current efficiency of 13%. This current efficiency of 13% at 45 psia is plotted as Data point 4 in FIG. 1.

EXAMPLE V

Under similar reaction conditions identical to those described in Example I—with the exception that no Group VIIIB catalyst was present, that the reaction CO pressure was 265 psia (18.0 atmospheres), and that the current was passed through the solution for five and one-third hours—a total of 1.20 grams (5.32 mmols) of bis(2,2,2-trifluoroethyl) carbonate was formed after passage of 0.019 faradays of elecytricity through the cell, corresponding to a current efficiency of 53%. This current efficiency of 53% at 265 psia is plotted as Data point 5 in FIG. 1.

EXAMPLE VI

Under similar reaction conditions identical to those described in Example I—with the exception that no Group VIIIB catalyst was present, that the reaction CO pressure was 415 psia (28.2 atmospheres), and that the current was passed through the solution for five and one-half hours—a total of 1.70 grams (7.52 mmols) of bis(2,2,2-trifluoroethyl) carbonate was formed after passage of 0.020 faradays of electricity through the cell, corresponding to a current efficiency of 73%. This current efficiency of 73% at 415 psia is plotted as Data point 6 in FIG. 1.

EXAMPLE VII

Under similar reaction conditions identical to those described in Example I—with the exception that no Group VIIIB catalyst was present, that the reaction CO pressure was 565 psia (38.4 atmospheres), and that the current was passed through the solution for five hours—a total of 1.70 grams of bis(2,2,2-trifluoroethyl) carbonate was formed after passage of 0.018 faradays of electricity through the cell, corresponding to a current efficiency of 80%. This current efficiency of 80% at 565 psia is plotted as Data point 7 in FIG. 1.

EXAMPLE VIII

Under similar reaction conditions identical to those described in Example I—with the exception that no Group VIIIB catalyst was present, and that the reaction CO pressure was 850 psia (57.8 atmospheres)—a total of 1.23 grams of bis(2,2,2-trifluoroethyl) carbonate was formed after passage of 0.013 faradays of electricity through the cell, corresponding to a current efficiency of 82%. This current efficiency of 82% at 850 psia is plotted as Data point 8 in FIG. 1.

As illustrated by the foregoing Examples, Group VIIIB catalysts enhance the electrochemical formation of β-fluoroaliphatic carbonates at high current efficiencies. In addition, the enhanced current efficiencies obtained by the use of Group VIIIB catalysts is also applicable at subatmospheric, atmospheric as well as superatmospheric pressures.

As used herein and in the appended claims the expression "β-fluoroalcohols" is generic to β-fluoroaliphatic alcohols, β-fluorocycloaliphatic alcohols, etc., including mixtures thereof, and "β-fluorocycloaliphatic carbonate" can be substituted for β-fluoroaliphatic carbonate.

I claim:

1. An electrochemical catalytic β-fluoroaliphatic carbonate process comprising reacting a β-fluoroalcohol, carbon monoxide, an effective amount of a Group VIIIB catalyst, an electrolyte containing a chloride, bromide or iodide ion using a direct electric current, subject to the proviso that the current efficiency of the process relative to the β-fluoroaliphatic carbonate product is at least about ninety-nine percent.

2. The claim 1 process and, additionally, a supplemental solvent.

3. The claim 1 process and, additionally, a supporting electrolyte.

4. The claim 1 process, wherein the carbon monoxide pressure is less than about 1,500 pounds per square inch.

5. The claim 1 process, wherein the β-fluoroalcohol contains 2–20 carbon atoms.

6. The claim 1 process, wherein the Group VIIIB catalyst is present in metallic form.

7. The claim 6 process, wherein the electrolyte contains a bromide ion.

8. The claim 7 process, wherein the β-fluoroalcohol is

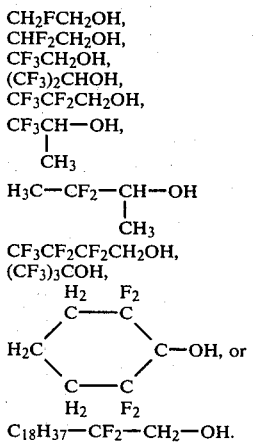

9. The claim 8 process, wherein the β-fluoroalcohol is 2,2,2-trifluoroethanol.

* * * * *